United States Patent [19]

Smith

[11] 4,042,096

[45] Aug. 16, 1977

[54] SHELF AID

[76] Inventor: Daniel F. Smith, 3278 N. 106th St., Milwaukee, Wis. 53222

[21] Appl. No.: 667,162

[22] Filed: Mar. 15, 1976

[51] Int. Cl.[2] ..... A47F 3/02

[52] U.S. Cl. ..... 211/49 D; 221/279

[58] Field of Search ..... 211/49 R, 49 D, 49 S, 211/134, 135, 153, 74, 126, 149, 186, 187, 122, 43, 51; 221/279, 280; 312/42, 45, 71, 72, 73, 97, 140.3, 140.4

[56] References Cited

U.S. PATENT DOCUMENTS

| | | | |
|---|---|---|---|
| 802,606 | 10/1905 | Stapp | 211/49 D |
| 1,708,407 | 4/1929 | Arnold | 211/49 D |
| 2,098,844 | 11/1937 | Waxgiser | 211/49 D |
| 2,852,143 | 9/1958 | Taber | 211/134 X |
| 2,934,212 | 4/1960 | Jacobsen | 211/49 D |
| 3,166,195 | 1/1965 | Taber | 211/49 S |
| 3,357,597 | 12/1967 | Groff | 221/279 |

*Primary Examiner*—Roy D. Frazier
*Assistant Examiner*—Terrell P. Lewis
*Attorney, Agent, or Firm*—Andrus, Sceales, Starke & Sawall

[57] ABSTRACT

A pusher is disposed behind a series of generally like objects stacked from back to front on a shelf. Side members tie the pusher to a pull handle at the front of the shelf and confine the stack of objects laterally in alignment. A rail is disposed at the front of the shelf to prevent objects from falling off the shelf as the pusher is drawn forward by the handle. Resilient means are disposed behind the pusher to return it and the handle to normal position after being drawn forward by a pull on the handle.

11 Claims, 7 Drawing Figures

SHELF AID

BACKGROUND OF THE INVENTION

This invention relates to a shelf aid to assist a store manager in keeping shelf goods properly positioned upon the shelves and assist a customer in seeing and removing shelf goods that may otherwise be out of sight or reach.

In grocery stores, particularly, there has been a need for some type of shelf aid to bring objects that are disposed near the back of the shelf forward to the front of the shelf where they can be more readily seen and removed by the customer.

It has been suggested heretofore to provide resilient means constantly biasing a series of objects forwardly against a front stop, whereby the first available object of the series is always in view and readily removable at the front of the shelf. Such devices, however, have not had sufficient biasing force to move heavier objects such as canned goods on grocery shelves, and frequently the objects in the series have become misaligned causing a malfunctioning of the device.

Another suggestion has proposed mounting the series of objects upon a movable strip of Mylar coiled at the forward end to provide a handle and to take up the slack after each successive object is drawn forward to a stop position. The employment of Mylar coils at the front of each series of objects on a shelf becomes unsightly and is not favored by customers who must operate coils of various sizes.

SUMMARY OF THE INVENTION

A pusher is provided behind each series of objects upon a shelf, and side members retain the objects of a series in alignment from front to back on the shelf and connect the pusher to a handle at the front of the shelf and which can be manually pulled forward to pull the pusher forward and thereby move the series of objects forward until the front object of the series engages a stop at the forward edge of the shelf.

After completion of the forward movement just described, the handle is released and a resilient, elastic or springy member attached to the pusher and to the rear of the shelf quickly returns the pusher to its starting position and the handle to the front of the shelf.

The side members are disposed at a height to effectively retain the objects in alignment and prevent their tipping laterally.

The front stop is disposed at a height to prevent the front object of the series from catapulting over the stop and falling to the floor in the event a customer pulls too rapidly upon the handle. At the same time the construction of the front stop should be such as not to obscure the label usually appearing on the front of the forwardmost object.

The pusher is retained against undue angular displacement which might tend to bias the rear object laterally. For this purpose the side members should be of equal length so that a straight pull on the handle will always effect a straight pull on the pusher.

BRIEF DESCRIPTION OF THE DRAWING

The accompanying drawings illustrate the best mode presently contemplated for carrying out the invention. In the drawings.

DESCRIPTION OF THE PREFERRED EMBODIMENTS

Figure 1:
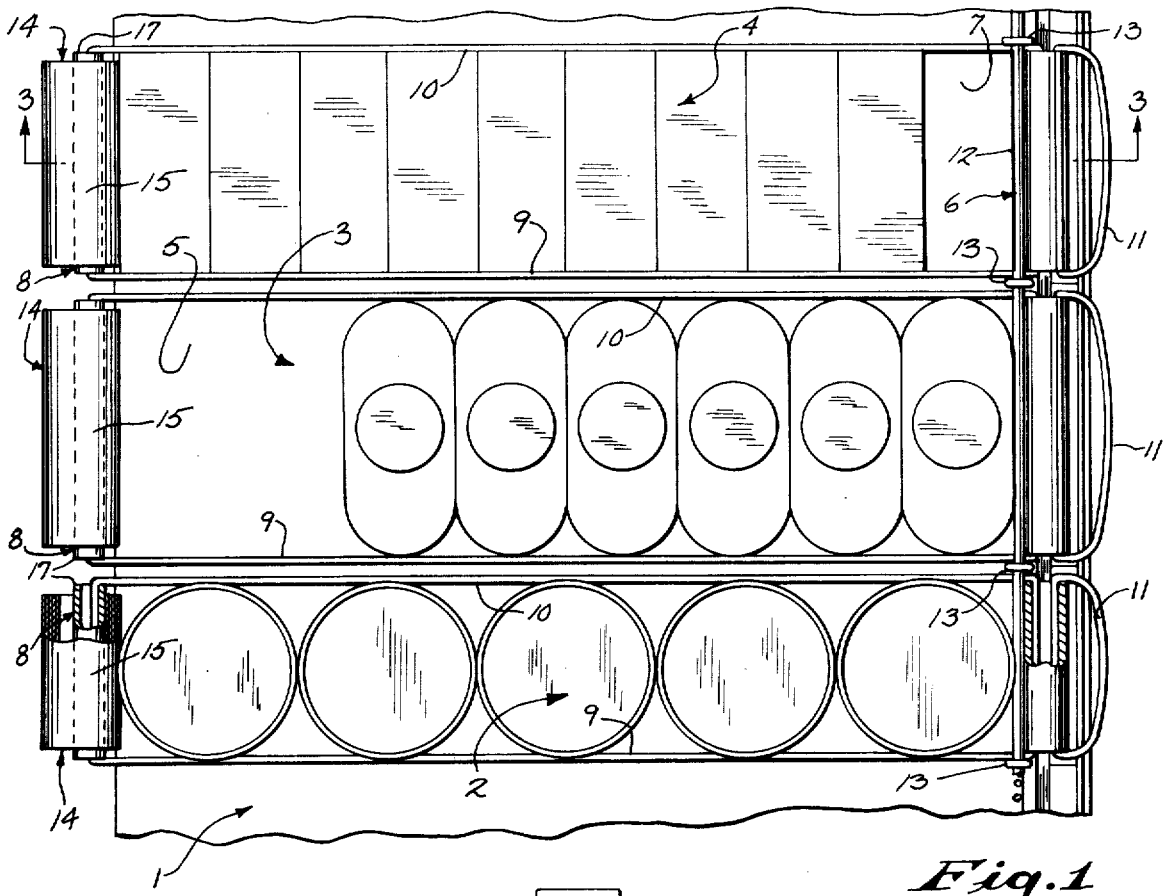
FIG. 1 is a top plan view of a portion of a shelf showing several series of different types of objects thereon with the apparatus of the present invention in position for each series.

The shelf aid illustrated in the drawings is shown as applied to the shelf 1 of a grocery store or other retail outlet.

The shelf 1 has a smooth, flat, and preferably waxed top surface for receiving separate side by side series of objects 2, 3 and 4 to be displayed for successive pick-up by customers.

The objects illustrated in series 2 are canned goods, and the cans are disposed in alignment in a row from front to back of the shelf with the cans filling the row leaving no vacant space from front to back.

The objects illustrated in series 3 are bottles of the banjo shape customarily used for salad dressings, etc. arranged similarly to the cans of series 2 but with the flat sides of the bottles transverse to the series and pressing against each other. There is a space 5 at the rear of series 3 indicating that after withdrawal of two bottles from the series the attendant has drawn the series forward to position the front bottle at the stop 6 where it is more visible to a customer.

The objects illustrated in series 4 are packaged materials with the packages of rectangular shape, and there is shown in Fig. 1 a space 7 at the front of the series where one package has been removed by a customer.

The stop 6 extends along the front edge of shelf 1 and rises above the shelf a sufficient height to properly stop the objects when they are drawn forward into engagement with it, and prevent the objects from toppling over the stop. The stop 6 may be a rail, or it may be of transparent material so as not to interfere with visibility of the labels on the front of the objects. Also stop 6 may have incorporated therewith suitable means for displaying price tags relative to the objects of each different series.

The mechanism for drawing a series of objects forward after a front object has been removed comprises a pusher 8 disposed at the rear of each series, side members 9 and 10 secured to the pusher 8 and extending forwardly therefrom along opposite sides of the series to a handle 11 disposed in front of stop 6.

The side members 9 and 10 should be at such a height above the shelf as to stabilize the series of objects in alignment, and prevent lateral displacement of any object when the series is being pushed forward by pusher 8.

The stop 6 is shown as a rail 12 spaced above shelf 1 at a height somewhat above the side members 9 and 10.

The side members 9 and 10 extend freely through the space beneath the rail 12 of stop 6 and are guided against lateral displacement by suitable spaced posts 13 supporting the rail 12. The rail 12 is preferably removable from posts 13 to provide ready access for assembling the various mechanisms required for the many series of objects along a section or length of the shelf.

Figure 2:
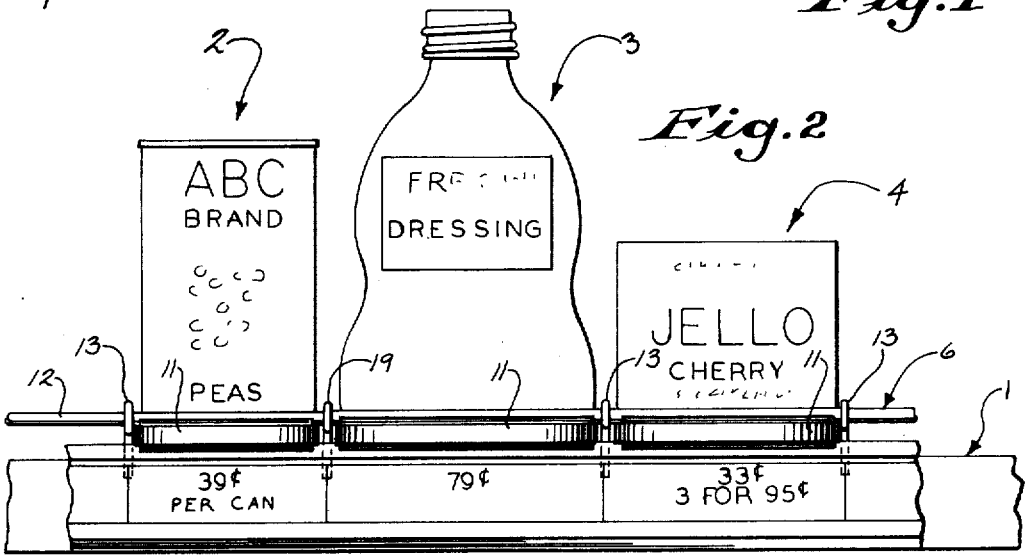
FIG. 2 is a front elevation of the illustration of FIG. 1.
Figure 3:
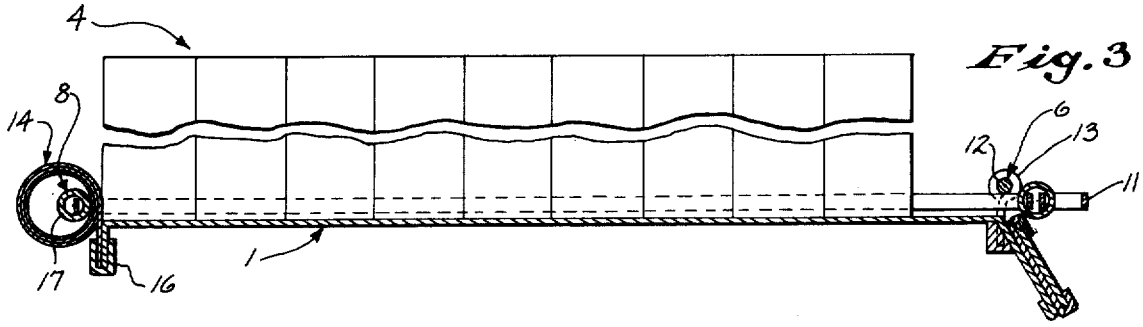
FIG. 3 is a section taken on line 3—3 of FIG. 1 and showing a series of objects in side elevation with the objects spaced from the front of the shelf.

The posts may be spaced sufficiently close to provide a stop for handles 11 when they are retracted to the position illustrated in FIGS. 1–3.

Figure 4:
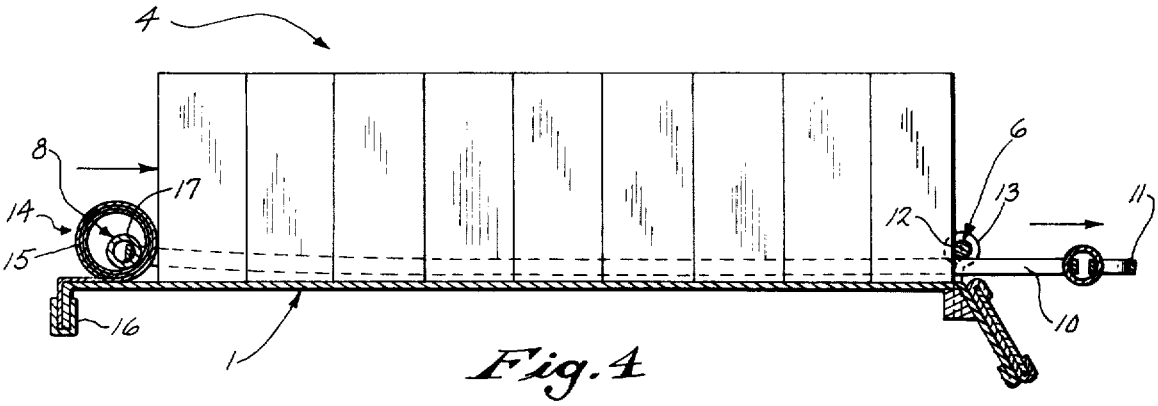
FIG. 4 is a view similar to Fig. 3 showing the pulling of the handle forwardly until the front object engages the stop.
Figure 5:
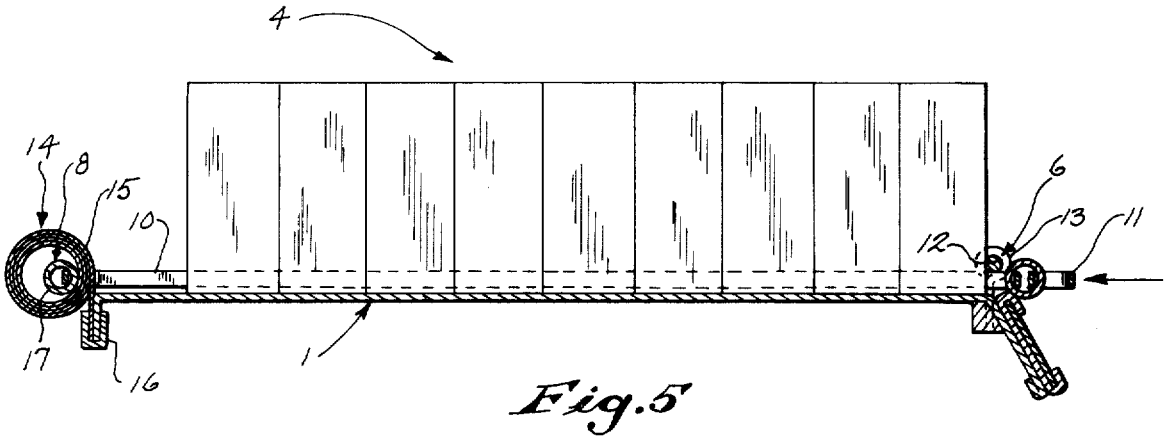
FIG. 5 is a view similar to Fig. 3 showing the return of the pusher and handle after the operation depicted in Fig. 4.

When a customer advances along an aisle in a store and desires to look at or take an object from a given series where the front object of the series is spaced rearwardly from the front of the shelf 1, as shown in FIG. 3, the customer grasps handle 11 and pulls it forwardly, thus pulling pusher 8 forwardly moving the objects to the front until stopped by engagement with rail 12 of stop 6, as shown in FIG. 4. The customer then releases the handle 11 and it is pulled back into engagement with posts 13 as shown in FIG. 5 by a return mechanism 14 associated with pusher 8.

The pusher 8 and return mechanism 14 may have various different constructions so long as they serve the purpose of permitting pusher 8 to push a series of objects forwardly on a shelf 1 and then returning the pusher 8 to retracted position at the rear of the shelf.

The mechanism 14 illustrated in FIGS. 1–5 generally comprises a mold convoluted self-recoiling roll 15 of Mylar polyester film, as manufactured by E. I. du Pont de Nemours & Co. of Wilmington, Delaware, a bracket 16 securing the free end of the Mylar strip to the back edge of shelf 1 and spool means 17 mounting the coil between the rear ends of side members 9 and 10. Further, in the construction illustrated in FIGS. 1–5, the side members 9 and 10 are secured to the spool 17 and the roll 15 is free to wind and unwind on the spool.

In this construction the roll 15 serves to contact the rear object in the series and to constitute the pusher 8 for moving the series forward.

Figure 6:
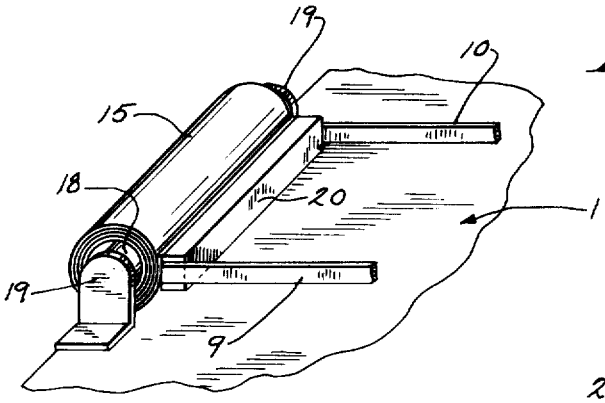
FIG. 6 is a detail perspective view illustrating a different embodiment for the pusher and return mechanism.

In the modification illustrated in FIG. 6, the self-coiling roll 15 is mounted for free rotation on the axis of a spool 18 which is supported on brackets 19 at the rear edge of shelf 1. The free end of the Mylar strip of roller 15 is secured to a transverse pusher plate or member 20 which in turn engages the rear object of the series in moving the latter forward. In this embodiment the side members 9 and 10 are secured directly to the opposite sides of pusher member 20.

The width of the Mylar strip, corresponding to the length of the roll 15 in both the embodiment of FIGS. 1–5 and the embodiment of FIG. 6 is preferably the same as the width of the objects in the given series in order to assist in stabilizing the pusher by the side members 9 and 10 in operation.

The Mylar strip needs very little force in merely returning the pusher 8 and handle 11 to retracted position. Consequently, it is possible to make the strip of a standard narrow width for all installations by employing the general construction of the FIG. 6 embodiment.

Figure 7:
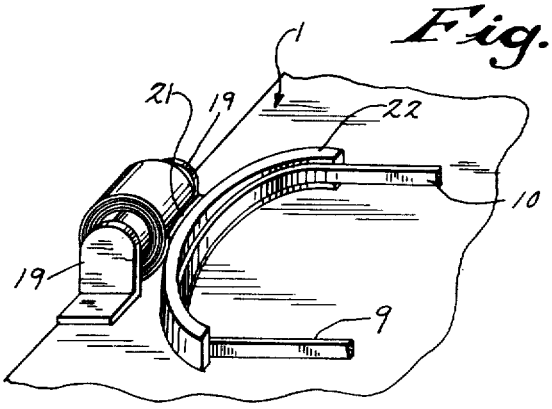
FIG. 7 is a similar detail view illustrating a third embodiment.

As shown in FIG. 7, this makes it possible to attach the free end of the Mylar strip 21 centrally to pusher member 22.

Additionally, the embodiment of FIG. 7 illustrates a semi-cylindrical pusher member 22 adapted to substantially fit objects of a given diameter and less whereby the side members 9 and 10 have better control in stabilizing the series against possible lateral displacement forces.

The return mechanism 14 may employ any suitable resilient, elastic or springy means for returning the pusher 8 to retracted position. Applicant has found the self-coiling roll of Mylar to be most suitable for this purpose when considering the distance of movement, the substantially constant spring rate over the full distance of movement, the spaces available, and a practical life expectancy for an installation.

The return mechanism 14 should not place any substantial load on pulling pusher 8 forwardly, and on the other hand, the construction has a substantially advantage in always utilizing a direct manual pull in overcoming any friction against forward movement of the objects of a series. The return mechanism 14 is not involved in any such frictional problems.

When a supermarket is equipped with the present invention the side members 9 and 10 serve as guides for the loading of objects and the filling of each series.

In the event it is desired to have the shelves present a full appearance without taking the time to re-load, an attendant need only walk along an aisle and pull the handles 11 for those series of objects that need pulling forward, and his store will immediately give the appearance of having the shelves full.

The customer is also benefitted since a pull on handle 11 will bring objects forward where they can be better identified and reached, and the front object can be removed for closer inspection and then returned without any problem if the customer does not choose to purchase it.

The side members 9 and 10 are preferably flexible and constitute tension members in pulling the pusher 8 forwardly and in returning the handle 11 and retaining it in retracted position against stop 6.

Various modes of carrying out the invention are contemplated as being within the scope of the following claims particularly pointing out and distinctly claiming the subject matter which is regarded as the invention.

I claim:

1. A shelf aid for displaying merchandise and the like in a plurality of adjacent series upon a shelf with each series containing like objects arranged in alignment from front to back on the shelf, comprising in combination with a shelf and a series of objects thereon, means including a pusher member at the rear of the series and tensioned side members extending forwardly therefrom separately encompassing each series of objects, a handle at the front of the shelf and attached to said side members for manually pulling the corresponding series of objects forwardly upon the shelf, a fixed stop extending upwardly from the shelf at its forward edge and engageable by the forward object of the series to limit the forward movement of said series, and resilient means constituting a part of said first named means and secured at the back edge of the shelf and to said pusher member to return said first named means and its handle to a rearwardly retracted position following a manual pulling thereof, said resilient means having a substantially constant spring rate.

2. The shelf aid of claim 1 in which said tensioned side members are flexible to accommodate different size objects.

3. The shelf aid of claim 1 in which said resilient means comprises a self-recoiling roll of polyester film carried by said pusher member.

4. The shelf aid of claim 3 in which said resilient means comprises a self-recoiling roll of polyester film mounted on brackets at the rear of the shelf, and means securing the free end of said film of said pusher member.

5. The shelf aid of claim 4 in which said roll is substantially shorter than the width of the series of objects, and the free end of the film is attached only to the central region of said pusher member.

6. The shelf aid of claim 4 in which said pusher member is shaped to embrace the rearmost object of the series laterally on opposite sides thereof.

7. The shelf aid of claim 1 in which said last named means comprises a self-recoiling roll of polyester film engageable with the rear object of the series, and the pusher member extends substantially axially of the roll with the latter free to rotate thereon.

8. The shelf aid of claim 1 in which said stop comprises a rail removably mounted on posts secured at the front of the shelf and positioned at a height to prevent the toppling of objects when engaged thereby as a result of a rapid forward movement of the series.

9. The shelf aid of claim 8 in which said stop minimally interferes with freedom to observe a label on the front object of the series.

10. The shelf aid of claim 8 in which said stop determines the retracted position for said handle.

11. The shelf aid of claim 2 in which said side members are under constant tension from said resilient means in pulling the pusher member forward and in returning said handle and retaining it in retracted position.

* * * * *